US005854145A

United States Patent [19]

Chandler et al.

[11] Patent Number: 5,854,145

[45] Date of Patent: Dec. 29, 1998

[54] CORROSION INHIBITOR SOLUTION APPLICATOR

[75] Inventors: Christophe Chandler, Woodbury; Margarita Kharshan, Little Canada; Dan L. Dusing, Moundsview; Paul Jaeger, St. Paul, all of Minn.

[73] Assignee: Cortec Corporation, St. Paul, Minn.

[21] Appl. No.: 871,113

[22] Filed: Jun. 9, 1997

Related U.S. Application Data

[63] Continuation-in-part of Ser. No. 855,920, May 14, 1997, abandoned.

[51] Int. Cl.[6] ..... D03D 03/00

[52] U.S. Cl. ..... 442/59; 442/327; 106/8; 106/14.13; 106/14.18; 106/14.28; 252/392; 252/396

[58] Field of Search ..... 442/59, 327; 106/8, 106/14.13, 14.18, 14.28; 252/392, 396

[56] References Cited

U.S. PATENT DOCUMENTS 4,448,699 5/1984 Barrat et al. ..... 252/8.75

4,675,125 6/1987 Sturwold ..... 252/118

*Primary Examiner*—Helen L. Pezzuto

*Attorney, Agent, or Firm*—Haugen and Nikolai, P.A.

[57] ABSTRACT

A package for facilitating the protection of metallic surfaces against corrosion and including a blend of corrosion inhibitor and surface-conditioning component such as a degreaser, descaler, and/or anti-static component in liquid state impregnated into a substrate such as a wipe for simultaneous and direct application to the surface of the article being protected. The corrosion inhibitor component is preferably an amine salt of carboxylic acid, triazole, an alkali metal salt of aldonic acid, or alkanolamine salts of fatty acids, an alkali metal or alkanolamine salt of aromatic sulfonic acid, or blends thereof. The substrate is preferably a wipe fabricated from a fabric such as soft cotton, but may also include other wipe materials such as woven or non-woven polyolefin fabric, or non-woven materials such as paper toweling.

12 Claims, 1 Drawing Sheet

CORROSION INHIBITOR SOLUTION APPLICATOR

CROSS-REFERENCE TO RELATED APPLICATION

The present application is a continuation-in-part of our application Ser. No. 08/855,920, filed May 14, 1997, entitled "CORROSION INHIBITOR SOLUTION APPLICATOR", and assigned to the same assignee as the present application now abandoned.

BACKGROUND OF THE INVENTION

The present invention relates generally to highly effective corrosion inhibitors, and more particularly to a package incorporating a substrate impregnated with a formulation and a packaging arrangement for protecting metallic surfaces against corrosion, with the formulations including, in combination, corrosion inhibitor components, together with cleaning components wherein the formulation may be simultaneously applied directly to the surface of the metal to be protected by a wiping action. The application of the corrosion inhibitor components in combination with a surface-conditioning agent such as a cleaning component, degreaser component, descaler component, surface wax component, and/or a component to reduce static buildup, enables the corrosion inhibitor component to come into contact with the fresh surface of the metal, and with the surface-conditioning component enhancing the effectiveness of the inhibitor component upon such direct application to the surface. For most applications, a degreaser component renders the corrosion inhibitor highly effective, while rust removers, descalers, waxes and anti-static components condition the surface so that specific application renders the inhibitor more highly effective.

In the past, various corrosion inhibiting components have been employed in a variety of forms to provide protection over extended intervals of time to surfaces of metallic objects. In addition, materials such as layers of Cosmoline® or the like have been utilized to provide long-term protection to various articles or objects prior to and during storage. In accordance with the present invention, the advantageous features of each of these materials have been augmented by implementation and incorporation or impregnation of a cleaner and degreaser into a substrate such as a wipe, with an optional descaler component being included for simplifying cleaning and application for further enhancing the long-term protection available from certain corrosion inhibiting materials.

As has been recognized, corrosion inhibitors have been utilized in the past for protection of metallic objects. Typically, such utilization includes the incorporation of a quantity of such an inhibitor which sublimates to provide continuous exposure of the component being protected to an inhibitor. It has been found that the utility of such inhibitors is enhanced if applied directly to a freshened surface of a metallic object, the surface of which is being protected. As utilized herein, the term "degreaser" will be used in a comprehensive sense and incorporates, in particular, materials such as mineral spirits, aromatic solvents, water emulsions or alcohols in addition to and in preference to the polyhalogenated hydrocarbons. Briefly, the term is employed to refer to a solvent for fat or grease, as the term is employed in many industrial and other applications.

Descalers may be incorporated in the formulation of the present invention for particular applications. Typical descalers useful in combination with corrosion inhibitors and degreasers in the present formulations include ethylene diamine tetra acetic acid and its salts, salts of hydroxy polycarboxylic acids, and phosphoric acid salts, with each of these materials being recognized as being highly effective for scale removal such as those created from oxidation or the like upon the surfaces of metallic objects. As used herein, the term "descaler" will normally be utilized in a comprehensive sense, and is intended to include those useful materials such as ethylene diamine tetra acetic acid and its salts, salts of hydroxy polycarboxylic acids and phosphoric acid salts and other compounds commonly used for metal oxidation removal.

Anti-static components may be incorporated in the formulation of the present invention for particular applications, particularly in the electrical and electronic fields. Typical anti-static components include such materials as ethylene glycol monobutyl ether, nonylphenoxyethoxyethanol, polyethylene glycol, and mixtures thereof. The term "anti-static agent" will normally be utilized in a comprehensive sense, and includes those materials generally found useful in the elimination and/or reduction of buildup of static charge.

SUMMARY OF THE INVENTION

In the utilization of the formulation of the present invention, the corrosion inhibitor/surface-conditioners such as a degreaser, descaler and/or anti-static formulation will typically be contained or retained within a wipe or other absorbent medium, making it possible for simultaneous direct application of the corrosion inhibitor/surface-conditioners such as a degreaser, descaler and/or anti-static formulation to the metallic surface being protected. Typically wipes include fabrics such as soft cotton, but also include other wipe materials such as polyolefins as non-wovens and paper toweling as examples. The container vessel is preferably in the form of a canister or tub receptacle or enclosure vessel, or a pouch may be utilized. Briefly, a receptacle is provided for appropriately retaining or containing the formulation consisting of its various components for impregnation in an appropriate wipe.

In actual use, the corrosion inhibitor/surface-conditioners such as a cleaner, degreaser, descaler and/or anti-static formulation, while held as an impregnant in an appropriate wipe, is spread from the wipe onto the surface of metal to be protected. The cleaning component functions to remove any accumulation of dirt and/or dirt-retaining grease, fat, or oil, thereby cleaning the metallic surface for simultaneous fresh and complete contact with the corrosion inhibiting component. The inhibitor, when placed into direct contact with the metal in this fashion, is then able to better perform its function of protecting the surface of the metal against corrosion which would be likely to otherwise occur due to the creation of oxides, sulfides, and the like. Normally, the inhibitor selected for this application will be one that has a relatively low sublimation rate under the conditions contemplated for the application. As indicated above, a descaler component may be added to the formulation when its use and application is indicated.

Each component selected for the formulation is appropriately adapted for incorporation and use either within or on the surface of a wipe, and as indicated above, appropriate wipes may consist of cotton, polyolefins, or paper, non-wovens or combinations thereof. Wipes suitable for retention of the formulations of the present invention are, of course, commercially available.

Therefore, it is a primary object of the present invention to provide an improved formulation comprising an inhibitor component and a surface-conditioning component such as a cleaning component, with the formulation, in turn, being adapted for retention on or within an appropriate substrate or wipe, and with the formulation thereby being adapted to be applied to the surface of the metallic article to be protected for simultaneous cleaning and application of an inhibitor for long-term corrosion inhibiting action.

It is yet a further object of the present invention to provide an improved formulation for use in retention on the substrate selected to serve as a wipe, and with the formulation comprising a corrosion inhibiting component, and a surface-conditioning component preferably comprising a cleaning or degreaser component, an optional descaler component and/or an anti-static component as an additional element in the working formulation.

Other and further objects of the present invention will become apparent to those skilled in the art upon a study of the following specification, appended claims, and accompanying drawings.

IN THE DRAWINGS

FIG. 1 is a perspective view of a canister or tub enclosure appropriate for retention of a corrosion inhibitor/degreaser formulation, and with the formulation being disposed for contact and impregnation into an appropriate cloth wipe; and FIG. 2 is a detail top plan view of the impregnated wipes incorporated within the canister or tub enclosure illustrated in FIG. 1; and FIG. 3 is a perspective view of a pillow-pouch retaining an impregnated wipe prepared in accordance with the present invention.

DESCRIPTION OF THE PREFERRED EMBODIMENTS

Figure 1:
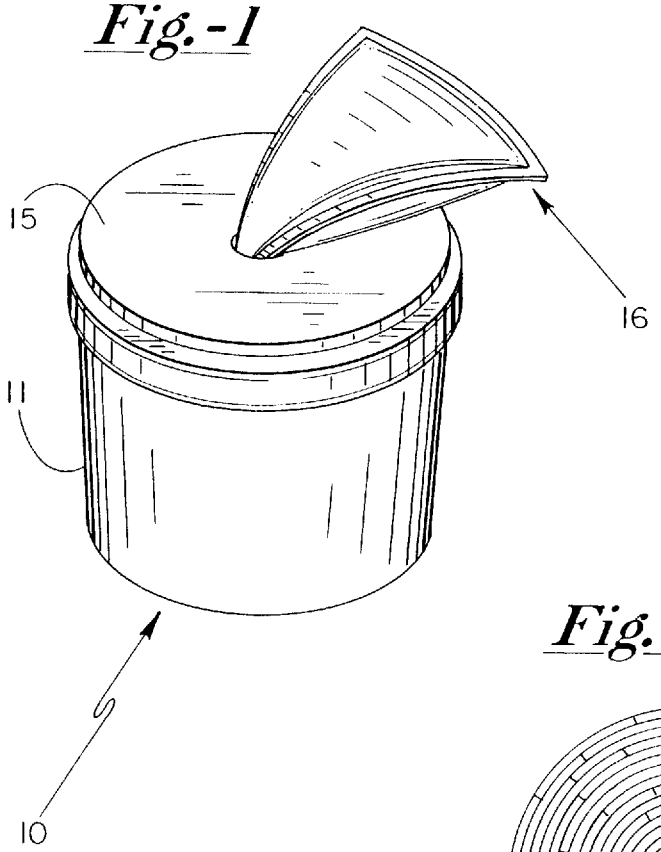

In accordance with the preferred embodiments of the present invention, the following examples are provided for preparation of packages containing wipes impregnated with formulations of corrosion inhibiting and surface-conditioning components such as degreasers, descalers, surface waxes, and/or anti-static combinations for use in long-term metal surface protection:

EXAMPLE I

Cleaner and Inhibitor Formulations (A) A corrosion inhibiting component consisting of sodium metasilicate (2–5 grams); sodium phosphonate (1–3 grams); the triethanolamine salt of dimer acid (10–15 grams); and an emulsifying agent Neodol 1-73B (5–10 grams), were mixed to form an emulsion of 5% by weight in water. The solution was an effective degreasing solution. The amine salt residue left on metallic articles prevented corrosion over relatively extended periods of time when the treated articles were subsequently exposed to a corrosive atmosphere. When the formulation is used in a pouch or container, the fabric wipe utilized provides a substrate which is useful in the method of simultaneously cleaning and providing corrosion inhibition. Neodol 1-73B is an emulsifier commercially available from Shell Chemical Company of Houston, Tex., and fabricated from an intermediate consisting of a blend of linear primary alcohols.

(B) An alternate formulation may be prepared as follows:

| Component | Percent by Weight |
|---|---|
| Tetrapotassium pyrophosphate | 0.5–2% |
| Oleic acid | 0.5–2% |
| Monoethanolamine | 0.5–2.5% |
| Neodol 91-6 | 1–2% |
| Water | 90–95%. |

These components are blended together to form an aqueous solution and impregnated into the cotton fabric wipe up to saturation. While various quantities may be employed, it is sufficient to note that the quantity for use will typically be indicated by the condition of the article requiring corrosion protection, as well as the area required. In use, the surface should be thoroughly wetted with the formulation, and the residual portion of the formulation which remains to wet the surface being permitted to remain on the surface following dirt and/or grease removal. Neodol 91-6 is an emulsifier commercially available from Shell Chemical Company of Houston, Tex., and fabricated from an intermediate consisting of a blend of linear primary alcohols.

EXAMPLE II

Wipe solutions useful for grease removing, rust removing, and corrosion inhibition can be prepared by mixing:

| Component | Percent by Weight |
|---|---|
| (A) Products from Example I(A) | 98.5% |
| Sodium citrate | 1% |
| Ammonium benzoate | 0.5% |
| (B) Products from Example I(B) | 98.5% |
| Sodium gluconate | 1% |
| Ammonium benzoate | 0.5% |
| (C) Products from Example I(A) | 98.5% |
| Sulfamic acid, sodium salt (50% solution) | 1.5% |
| Ammonium benzoate | 0.5%. |

These components are blended together to form a solution and impregnated onto the surface of a cotton fabric wipe with an amount up to saturation. While various quantities may be employed, it is sufficient to note that a quantity for use will typically be indicated by the condition of the article requiring corrosion protection, as well as the area required. In use, the surface should be thoroughly wetted with the formulation, and the formulation permitted to remain on the surface following dirt and/or grease removal. In the presence of the cleaning component, the wipe is impregnated as previously indicated, and the surface of the article being protected is treated for removal of the residue due to the presence of the cleaner and descaler. Residual liquid may be permitted to remain on the surface for corrosion inhibiting purposes.

EXAMPLE III

Rust Remover and Corrosion Inhibitor Formulations

Wipe solutions useful for rust removing and corrosion inhibition can be prepared by:

| Component | Percent by Weight |
|---|---|
| (A) Diammonium citrate | 15–20% |
| Citric acid | 1–5% |
| Sodium gluconate | 2–5% |
| Surfactant | 1–2% |
| Water | balance. |
| (B) Sulfamic acid | 10–12% |
| Sodium gluconate | 2–5% |
| Surfactant (Neodol 1–73B) | 1–2% |
| Water | balance. |
| (C) Sodium citrate | 10–15% |
| Sodium gluconate | 2–5% |
| Surfactant | 1–2% |
| Water | balance. |

The material is treated in accordance with the procedure outlined in connection with Example I above.

EXAMPLE IV

Wipe solutions useful for applying a polishing wax in combination with a corrosion inhibitor can be prepared by:

| Component | Percent by Weight |
|---|---|
| Dow Corning 536 fluid (an aminofunctional silicone fluid) | 0.5–1% |
| Dow Corning 531 fluid (an aminofunctional silicone fluid) | 5–6% |
| Dimer acid | 1–2% |
| Mineral spirits | 22–25% |
| Water | 55–60% |
| Surfactant (Witcomide 511) | 0.5–1% |
| Kaopolite SF | 5–10% |
| Thickener (Bentone 38, clay) | 0.1–0.5%. |

The dimer acid component is that acid produced by dimerization of unsaturated fatty acids at mid-molecule containing 36 carbon atoms. This material is a high molecular weight dibasic acid and is stable and liquid at room temperature. The mixture is treated in accordance with the procedure outlined in connection with Example II above. The silicone component functions as a wax-like film former for retention of other solid components when the solvent has been removed. Such wax-like film formers based upon silicone fluids are commercially available, as are other suitable wax-like film formers.

EXAMPLE V

As an additional example to those given hereinabove, a need arises for utilizing a corrosion inhibitor in combination with a component which reduces or eliminates static buildup on surfaces. Such a composition may also be incorporated in a wipe, and rendered suitable for use in the electronics industry for imparting a combined anti-static property to a corrosion inhibitor. In this arrangement, electronic as well as electrical components can be protected against corrosion and static charge buildup by impregnating a suitable paper, cloth or non-woven substrate to function as a wipe with an anti-static composition together with an appropriately selected corrosion inhibitor such as, for example, amine salts and triazoles. The following example is given:

| Component | Percent by Weight |
|---|---|
| Ethylene glycol monobutyl ether | 4–8% |
| Nonylphenoxypolyethoxy-ethanol | 2–5% |
| Polyethylene glycol | 12–15% |
| Dimethylethanol ammonium oleate | 1–2% |
| Benzotriazole | 0.5–1% |
| Deionized water | balance. |

The anti-static property is created through a combination of components, specifically ethylene glycol monobutyl ether, nonylphenoxypolyethoxyethanol and polyethylene glycol. These components, particularly in combination, provide a stable and compatible medium for the corrosion inhibitor components. While other suitable anti-static compounds may be found useful, the combination set forth in this example has been found to perform highly satisfactorily.

The anti-static component is compatible with other surface-conditioning components, particularly the cleaning and/or degreaser components set forth in Example I. Those individual components which provide the anti-static property and set forth in this Example V may be blended in the same relative proportions into the formulation of Example I with good results.

EXAMPLE VI

As a further example to those given hereinabove, and with respect to a corrosion inhibitor consisting of an alkalii metal or alkanolamine salt of aromatic sulfonic acid, such as dinonylnaphthalene sulfonic acid is utilized in combination with the components in the formulations set forth in Examples I through IV above. Such a composition is advantageously incorporated in a wipe, and rendered suitable for use in a variety of environments for imparting corrosion protection to a metallic article. In these formulations, the results may be obtained by impregnating a suitable paper, cloth, or non-woven substrate to function as a wipe together with an appropriately selected corrosion inhibitor consisting essentially of an alkali metal or alkanolamine salt of aromatic sulfonic acid such as the alkanolamine salt of benzene sulfonic acid. Alkali metal or alkanolamine salts of aromatic sulfonic acid are particularly effective when combined with triazole, particularly triazole in an amount ranging up to about 0.5% by weight in a formulation as given in this Example VI below. Typically, the triazole component will be present in an amount which is no greater than that of the alkali metal or alkanolamine salt of aromatic sulfonic acid. The following specific example is given:

| Component | Percent by Weight |
|---|---|
| Alkali metal phosphate | 0.5–2% |
| Alkali metal metasilicate | 0.5–2% |
| Ethoxylated linear alcohol | 1–2% |
| Alkanolamine salt of aromatic sulfonic acid | 0.5–2% |
| Triazole | up to about 0.5 |
| Deionized water | 90–95%. |

By way of further information, the advantageous properties of the formulation may be obtained pursuant to the following general formulation:

| Component | Percent by Weight |
|---|---|
| Sodium phosphate | 1.5% |
| Sodium metasilicate | 1.5% |
| Ethoxylated linear alcohol (C4–C12) | 1.7% |
| Triethanolammonium salt of dinonylnaphthalene sulfonic acid | 1.5% |
| Benzotriazole | 0.25% |
| Deionized water | balance. |

Ethoxylated linear alcohol is commercially available under the trade designation "Neodol 1-73B" available from Shell Chemical Company of Houston, Tex.

In certain applications, it may be deemed appropriate to provide a rust or scale remover component as well, such as the utilization of an alkali metal salt of sulfamic acid such as the sodium salt of sulfamic acid. In such a formulation, the sodium salt of sulfamic acid may be incorporated in the specific formulation of Example VI in an amount of 1.5% by weight, with a range of between 1% and 2% by weight having been found to be effective.

As indicated above, appropriate corrosion inhibiting components include those set forth in Examples I–VI, and it will be understood that alternate components may be successfully utilized, such as alkali metal salts and amine salts of aldonic, carboxylic, fatty or sulfamic acids, alkanolamine salts of aromatic sulfonic acid such as such salts of benzene sulfonic acid, all of which are, of course, commercially available. The corrosion inhibitor selected will, as indicated above, have a relatively slow sublimation rate under normal ambient conditions, thus enhancing and extending the useful lifetime of the formulation.

Appropriate degreaser components include those set forth in Examples I–II, and it will be understood that other degreaser components may be successfully utilized, such as alkyl carbonates, d-limonene, alkali metal polyphosphates, alkali metal metasilicates, and ethoxylated alcohols, and which are, of course, commercially available.

Appropriate descaler components include those set forth in Examples II and III, and it will be understood that other descaler components may be successfully utilized, such as hydroxycarboxylic acids and their salts, aldonic acids and their salts, amides of sulfonic acids and their salts, and which are, of course, commercially available.

The corrosion inhibitor/cleaner formulations typically contain 40% corrosion inhibitors, balance cleaner. In certain applications, it may be found desirable to incorporate a different range of corrosion inhibitors, such as between 20% and 80% inhibitor, balance cleaner. When a descaler is employed, this component, because of its nature, is typically present in an amount ranging from between 20% and 50% of the total formulation, although other ranges may be found suitable. With descalers, the ratio of inhibitor/cleaner present in the formulation will typically remain at 40% inhibitor, balance cleaner. In other words, a typical formulation containing a descaler will utilize 30% descaler, 28% corrosion inhibitor, with the balance of 42% being cleaner. The various formulations set forth are, of course, very useful in preparing the protection packages of the present invention.

Figure 2:
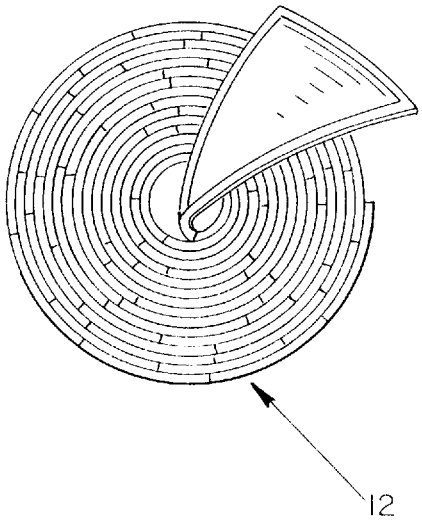

With attention now being directed to the drawings, the package generally designated 10 illustrated in FIG. 1 includes a canister or tub enclosure 11 in which a quantity of a blended corrosion inhibitor/degreaser formulation is retained, typically as an impregnant within a roll of the wipe medium, such as is illustrated in FIG. 2 at 12. The canister or tub enclosure is provided with a lid or snap-on cap as indicated at 15. The cover or cap 15 prevents loss of the active components including the corrosion inhibitor/degreaser blend.

Figure 3:
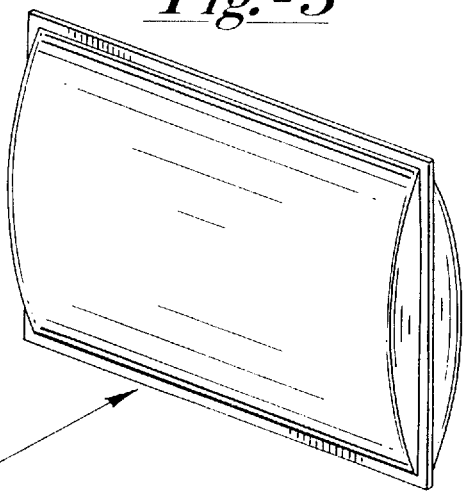

With attention being directed to FIG. 2 of the drawing, a coil of wipe material is shown generally at 12, with the wipe containing a quantity of corrosion inhibitor/degreaser blend to form a wipe medium. In this arrangement, a wipe may be conveniently contained or packaged in the arrangement of FIG. 1, or alternatively, in a suitable film envelope or bag 16, and removed for a one-time use as in FIG. 3. The blend of Example I(A) hereinabove has been found particularly suitable for application in either package.

Additionally, a variety of other suitable substrates are also commercially available. Such substrates typically consist of paper toweling or other natural fibers, polypropylene, or the like. In addition, polypropylene-based wipes may incorporate abrasive fibers on the surface for assisting in release of dirt and grease from the surface being protected. Such wipes are commercially available from Kimberly-Clark Corp. of Neenah, Wis. under the trade designation "SATWIPES" and "PROSAT".

It will be appreciated that the examples given herein are for purposes of illustration only and are not to be construed as a limitation upon which this invention may be otherwise entitled.

What is claimed is:

1. A package for facilitating the protection of metallic surfaces against corrosion and comprising, in combination:

(a) a formulation which includes;

(i) corrosion inhibitor component in liquid state;

(ii) a surface-conditioning component selected from the group consisting of degreasers, descalers, anti-static, surface wax components, and mixtures thereof; and (b) a container receptacle having a bottom and side walls, and an open top and retaining said formulation;

(c) substrate means disposed within said container receptacle in contact with said formulation for retention of said formulation in a wipe for simultaneous and direct application to the surface of the article being protected; and (d) said corrosion inhibitor component is selected from the group consisting of amine salts of carboxylic acids, alkali metal salts of aldonic acids, and alkanol amine salts of fatty acids.

2. The package as defined in claim 1 wherein the degreasing component is selected from the group consisting of alkyl carbonates and ethoxylated alcohols.

3. The package as defined in claim 1 being particularly characterized in that a film-forming component is present.

4. The package as defined in claim 3 wherein said film-former is an aminofunctional silicone fluid.

5. The package as defined in claim 1 being particularly characterized in that said corrosion inhibitor component is selected from the group consisting of alkali metal or alkanolamine salts of aromatic sulfonic acid.

6. The package as defined in claim 5 wherein said alkali metal or alkanolamine salt of aromatic sulfonic acid is dinonylnaphthalene sulfonic acid.

7. A package for facilitating the protection of metallic surfaces against corrosion and comprising, in combination:

(a) a formulation which includes;

(i) corrosion inhibitor component in liquid state;

(ii) a degreasing component; and (iii) a descaler component; and (b) substrate means for retention of said formulation in a wipe for simultaneous and direct application to the surface of the article being protected; and (c) said corrosion inhibitor component is selected from the group consisting of amine salts of carboxylic acids, alkali metal salts of aldonic acids, and alkanol amine salts of fatty acids.

8. The package as defined in claim 7 wherein the degreasing component is selected from the group consisting of alkyl carbonates and ethoxylated alcohols.

9. The package as defined in claim 7 wherein the descaler component is selected from the group consisting of ethylene diamine tetra acetic acid and its salts, hydroxycarboxylic acid salts and phosphoric acid salts.

10. A package for facilitating the protection of metallic surfaces against corrosion comprising a light cleaning oil, a corrosion inhibitor component compatible with said light oil, and a substrate for the formulation in admixture in the substrate for application directly to the surface of the metal being protected, said corrosion inhibitor component being selected from the group consisting of amine salts of carboxylic acids, alkali metal salts of aldonic acids, and alkanol amine salts of fatty acids.

11. A package for facilitating the protection of metallic surfaces against corrosion and comprising, in combination:

(a) a formulation which includes;

(i) corrosion inhibitor component in liquid state, said corrosion inhibitor component being selected from the group consisting of amine salts of carboxylic acids, alkali metal salts of aldonic acids, and alkanol amine salts of fatty acids; and (ii) an anti-static compound; and (b) substrate means for retention of said formulation in a wipe for simultaneous and direct application to the surface of the article being protected.

12. The package as defined in claim 11 wherein the anti-static compound is selected from the group consisting of ethylene glycol monobutyl ether, nonylphenoxypolyethoxyethanol, polyethylene glycol, and mixtures thereof.

* * * * *